US009174774B2

(12) United States Patent
Peplinski

(10) Patent No.: US 9,174,774 B2
(45) Date of Patent: Nov. 3, 2015

(54) CONTAINERS FOR COOKING FOODSTUFFS

(75) Inventor: Mark Peplinski, Whitchurch (GB)

(73) Assignee: Excelsior Technologies Limited, Flintshire, Clwyd (GB)

( * ) Notice: Subject to any disclaimer, the term of this patent is extended or adjusted under 35 U.S.C. 154(b) by 985 days.

(21) Appl. No.: 11/399,022

(22) Filed: Apr. 5, 2006

(65) Prior Publication Data

US 2006/0222744 A1 Oct. 5, 2006

(30) Foreign Application Priority Data

Apr. 5, 2005 (GB) ..... 0506847.3

(51) Int. Cl.
*B29D 22/00* (2006.01)
*B65D 33/25* (2006.01)
*B65D 81/34* (2006.01)

(52) U.S. Cl.
CPC ..... *B65D 33/2508* (2013.01); *B65D 81/3461* (2013.01); *B65D 2205/00* (2013.01)

(58) Field of Classification Search
USPC ..... 383/116, 101, 63; 219/735, 729; 229/123.1; 426/107; 428/35.7; 99/403; 206/810
See application file for complete search history.

(56) References Cited

U.S. PATENT DOCUMENTS 4,792,240 A * 12/1988 Ausnit ..... 383/63
5,017,021 A * 5/1991 Simonsen et al. ..... 383/63
5,709,915 A * 1/1998 Tomic et al. ..... 428/35.2
6,010,244 A 1/2000 Dobreski et al.
2003/0123758 A1 7/2003 Mita et al.
2003/0152296 A1 8/2003 Huffer
2005/0003150 A1 1/2005 Lin
2005/0281491 A1 * 12/2005 Ausnit ..... 383/64

FOREIGN PATENT DOCUMENTS

EP 0 661 219 A2 7/1995
JP 2000-072157 * 8/1998
JP 11-178713 7/1999
JP 11-189278 7/1999
JP 2000-72157 3/2000
JP 2000-327046 11/2000
WO WO 03/095329 A1 11/2003

OTHER PUBLICATIONS

Machine transalation of JP 11-189278.*
Translation of JP 11-189278.*
International Search Report for PCT/GB2006/001193 mailed Oct. 4, 2006, 6 pages.
International Preliminary Report on Patentability for PCT/GB2006/001193 mailed Oct. 9, 2007, 12 pages.
Written Opinion of the International Searching Authority for PCT/GB2006/001193 mailed Oct. 5, 2007, 11 pages.

* cited by examiner

*Primary Examiner* — Ellen S Wood
*Assistant Examiner* — Anthony J Frost
(74) *Attorney, Agent, or Firm* — Blakely, Sokoloff, Taylor & Zafman LLP

(57) ABSTRACT

The present invention is concerned with flexible cooking containers which the user can fill with selected foodstuff and then seal same prior to inserting in the microwave oven for preferably cooking the contents at greater than atmospheric pressure for improved health/hygiene reasons and for improved taste and flavor. The user can thus select the nature of the foodstuffs which are to be cooked.

14 Claims, 2 Drawing Sheets

CONTAINERS FOR COOKING FOODSTUFFS

CROSS-REFERENCE TO RELATED APPLICATIONS

The present patent application claims priority from Great Britain Patent Application No. 0506847.3, filed on Apr. 5, 2005.

BACKGROUND OF THE INVENTION

The present invention concerns improvements in or relating to cooking containers for use in cooking foodstuffs, particularly microwave cooking of foodstuffs.

There are several cooking containers in the market place which are usually in the form of bags or pouches, and contain foodstuffs sealed therewithin. Such containers are usually rectangular in shape and are formed of plastics film material, suitably laminated.

A problem associated with such containers is that when the container is heated in a microwave oven, vapour generated from the foodstuffs in association with the heating increases the gas pressure inside the container and this increased gas pressure may burst open the container so that the product may be destroyed and scattered inside the microwave oven. In order to alleviate such gas pressure increase the container may be partially broken open or an opening be cut therein so as to communicate the inside of the container with the ambience to allow escape of the vapour generated from the foodstuff during its heating. However, such method can make the heat cooking more problematic. In addition, if the user forgets to form such opening procedure prior to heating and the foodstuff remains sealed in the container when same is heated, then such may well result in the bursting of the container body.

Further devices are available which are provided with means whereby, when the container is being heated and the pressure builds up, the pressure is allowed to be removed by suitable venting means which become operational when the pressure within the container reaches a selected level.

Currently, the majority of cooking containers, in the form of bags or pouches, are prepared in a ready sealed manner with the foodstuff therein. Such containers are purchased from a retail outlet and the user then places same in the microwave oven and cooks same with the pressure being relieved by the venting means referred to above.

SUMMARY OF THE INVENTION

The present invention is concerned with flexible cooking containers which the user can fill with selected foodstuff and then seal same prior to inserting in the microwave oven for preferably cooking the contents at greater than atmospheric pressure for improved health/hygiene reasons and for improved taste and flavour. The user can thus select the nature of the foodstuffs which are to be cooked.

According to the present invention there is provided a cooking container, suitably in the form of a bag or pouch, and preferably of substantially rectangular form, such container being formed of plastics film or sheet material with the bottom and sides of the container being sealed together and the top portion thereof being provided with sealing means for sealing the container after foodstuffs have been inserted into the container body, such sealing means being such as to remain sealed when the product is cooked, such container containing venting means to enable the pressure within the container to be controlled when cooking takes place.

The upper portion of the container can be sealed by the user after inserting foodstuffs into the container body. A suitable sealing means comprises a zip-like or press-fit arrangement wherein on the inner side of each of the opposite portions of the plastics laminate film in the region of the top portion thereof, a pair of plastics material strips are secured to respective inside portions of the plastics material film forming said side portions of the container. When the two sides of the container are pressed together in the top portion region, the two strips cooperate and form a sealing means.

It is possible to select material for such sealing means which will ensure that, when sealed, the container will not burst open in such top portion when the container is placed in a microwave oven and cooking therein takes place.

In an embodiment of the invention, the sealing means is in the form of two strips of plastics material, one strip secured to each inner side of the plastics film material in the region of the top portion thereof having press-fit means associated therewith whereby when such strips are pressed together a seal is formed and wherein the lower portion of one of the strips is not secured to the inside of the plastics material in the top portion of the container to leave a flap member which, when the pressure increases inside the cooking container when cooking takes place, is forced up into the region of the press-fitting seal between the two plastic strip members and thereby prevents such press-fitted sealing means from being breached.

Various modifications can be made to the cooking container referred to above in accordance with particular requirements for each type of cooking which is to take place.

In a further embodiment, the sealing means can be reusable so that once cooking has taken place of foodstuffs then same can be removed from the cooking container which can then be internally cleaned and thereafter used for further foodstuffs.

Also according to the present invention there is provided a pouch or bag of flexible plastics material for cooking food therein under pressure having an access opening or mouth closable by means of a releasable sealing or closure means in the form of a press-fit bead-and-groove or rib-and-channel closure means wherein the projection portion is on a first strip of plastics material secured along its length to an inner surface of one side of the bag wall, and the groove or channel forming portion is formed on a second strip of plastics material secured along its length to an inner surface of a second and opposite side of the bag wall, the strip portion is secured so as to leave a freely extending portion carrying the bead or the groove presenting when the closure is closed, a surface opposite to that where the bead or groove is formed such as to present said surface exposed to steam and other pressure during cooking the contents of the bag as to urge the bead and groove portions together to maintain the seal.

Further according to the present invention there is provided a bag in which one of said strips is secured along its length to the bag material at least along upper and lower regions thereof either side of the respective bead or groove closure portion whilst the other said strip is only secured along its length on that side of the respective groove or bead respectively which is most adjacent the mouth of the bag.

Still further according to the present invention there is provided a bag wherein the strips are less flexible than the walls of the bag to expose the unsecured face to steam action.

The pouch or bag material will normally be formed of laminated sheet material of polyester and polypropylene or polyester and polyethylene with the polyester being on the outside, and for the closure means such are preferably polypropylene or polyethylene (depending on the inner layer of the laminated sheet). The outer layer of the laminated sheet may also be polypropylene or polyamide or any plastic film which provides strength and/or temperature resistance.

BRIEF DESCRIPTION OF THE DRAWINGS

The present invention will be further illustrated, by way of example, with reference to the accompanying drawings, in which.

DETAILED DESCRIPTION OF THE INVENTION

Figure 1:
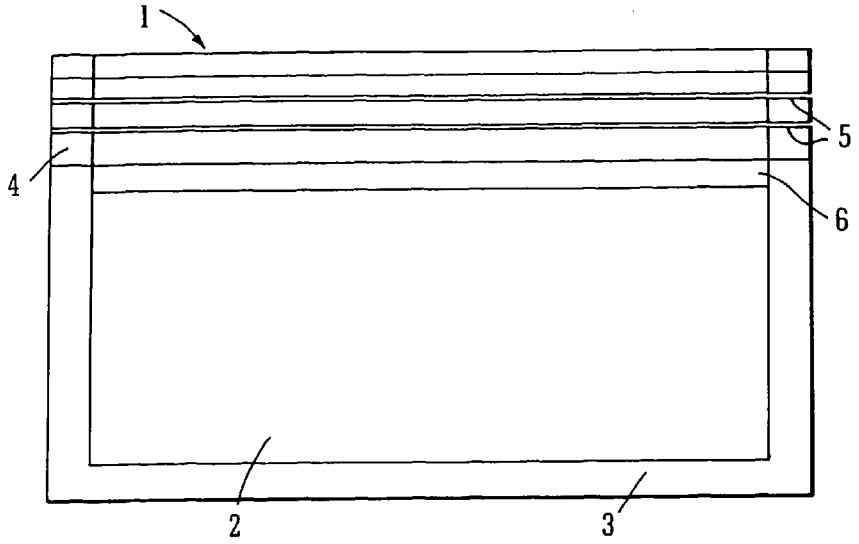
FIG. 1 is a schematic elevational view of an upstanding cooking container in accordance with an embodiment of the present invention.

As illustrated, a cooking container in accordance with an embodiment of the invention comprises a substantially rectangular cooking bag formed of plastics material film generally identified as 1. Such bag 1 has side portions 2 within which foodstuffs can be located for cooking in a microwave oven. The bag 1 is sealed at its bottom and side regions as indicated by reference numeral 3. The top portion of bag 1 has a sealing arrangement 4 provided in the top portion thereof having press-fit attachment means 5 associated therewith.

Figure 2:
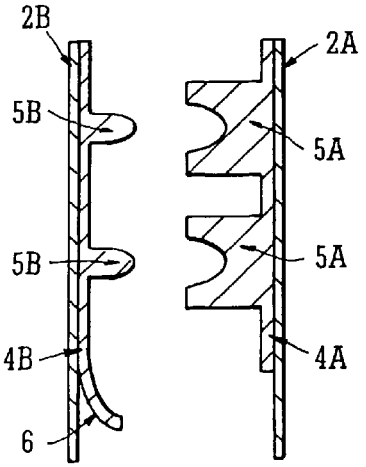
FIG. 2 is a section through the top portion of the container of FIG. 1 showing the press-fit sealing arrangement in an unengaged position.

As illustrated in FIG. 2, the sealing arrangement 4 comprises two sealing means or strips 4*a* and 4*b* respectively attached to the inside of the plastics material film material 2*a* and 2*b*. The sealing means 4*a* is provided with press-fit attachment means 5*a* which, in use, will engage with press-fit attachment means 5*b*.

The sealing means 4*b* is not secured at its underside or lower portion to plastics film material 2*b* which thereby in effect provides a flap 6 which is urged by pressure against sealing means 4*a* to maintain the sealing effect under pressure.

Figure 3:
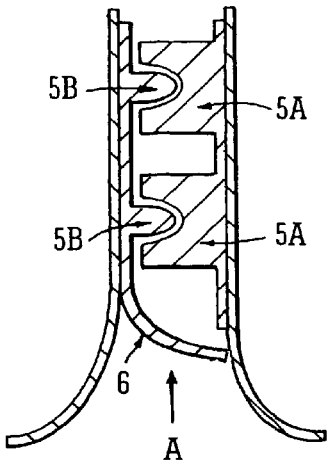
FIG. 3 is a similar cross-section as in FIG. 2 with the press-fit arrangement shown in the engaged position.

As illustrated in FIG. 3 the bag is represented in its sealed condition with press-fit portions 5*a* and 5*b* interengaged. As the container 1 as illustrated in FIG. 3 is subjected to cooking, pressure A will build up in the container and such pressure will cause the sealing means flap 6 to move in the manner illustrated in FIG. 3 which thereby provides an additional means of sealing the device and which will prevent or minimise the escape of the vapour having pressure A via the sealing means 5*a* and 5*b*.

The cooking bag 1 will normally be provided with appropriate venting means in order to enable vapour to escape from the bag when the pressure builds up during cooking and allow for the control of the pressure.

When cooking has been completed, the interengaged press-fitting sealing arrangement can be disengaged and the cooked foodstuffs can then be removed therefrom.

If desired the embodiment of FIG. 1 to 3 may have simply one press-fit attachment or closure means i.e. a single elongate bead 5*b* and a single elongate groove or channel 5*a*. Two distinct said closure means may be provided.

Figure 4:
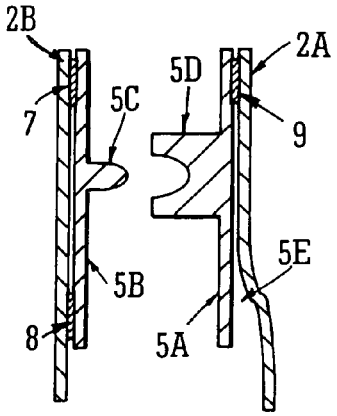
FIG. 4 is a schematic fragmentary cross-sectional detail on enlarged scale of a second embodiment of the invention.
Figure 5:
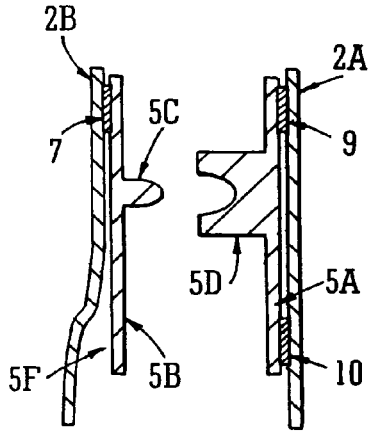
FIG. 5 is a view similar to that of FIG. 4 of a third embodiment of the invention similar to that of FIG. 4 but an opposite arrangement.
Figure 6:
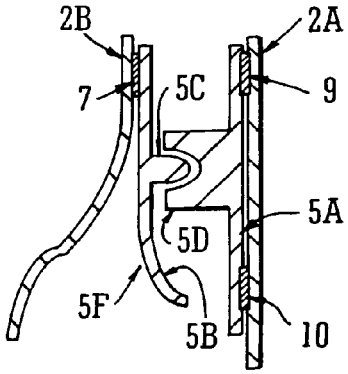
FIG. 6 is a view of the embodiment of FIG. 5 showing the press-fit closure closed.

In FIGS. 4 to 6, the similar reference numerals are used for the similar parts as FIGS. 1 to 3. Thus walls 2A and 2B form portions of side walls defining the mouth of a plastics pouch bag (not shown) in full but which may be similar to that of FIG. 1 for receiving foodstuff to be cooked in a microwave oven under pressure. The bag will normally be provided with a pressure relief means or valve (not shown) such as described in EP 0661219.

Releasable sealing or closure means in the form of press-fit bead and groove closure means 5A, 5B are illustrated in FIG. 4 comprising two elongate strips of plastics material with that carrying the projection or bead 5C being heat or ultrasonically welded at 7 and 8 along the length of upper and lower regions to the inner side wall 2B of the bag to seal therewith. The strip 5A carrying the channel or groove 5D is only welded at an upper region 9 along the length thereof that when the closure is closed, and as pressure of steam within the bag builds up during cooking, steam will act against the surface 5E of the strip 5A which is exposed to the steam which urges such against the bead 5C to maintain the closure means in the closing condition.

In the embodiment of FIG. 5, the arrangement that if FIG. 4 is reversed in that strip 5B is only welded along its length at its upper region 7 and strip 5A is welded at upper end have regions 9, 10 so that when the closure 5A, 5B is closed it is the strip 5B which flexes under steam pressure and is urged against strip 5A to maintain projection 5C in channel 5D when cooked under pressure.

The arrangement of FIG. 6 is very similar to that of FIG. 5 wherein strip 5B with bead 5C is only sealed at an upper region along its length and bead 5C is urged to be maintained in groove 5D when cooked under pressure.

Figure 7:
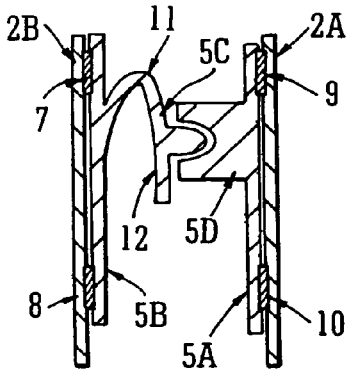
FIG. 7 is a view similar to those of FIGS. 4 to 6 of a fifth embodiment of the invention where the flap extends from the strip and carries the projection portion.

An alternative embodiment is illustrated in FIG. 7 wherein strips 5A and 5B are each welded along upper and lower regions 9, 10, 78 and strip 5B has an elongate flexible extension portion 11 extending along its length and carrying projection 5C which sealingly engages by press-fit in channel 5D. Thus steam during cooking acts against surface 12 to urge the closure portions 5C, 5D together during cooking to maintain the seal under pressure.

It is to be noted that the relative stiffness or less flexible nature of the material of the strips 5A and 5B relative to the much more flexible nature of the sheet material from which the bag is formed results in the closed position of the closure means of the facing portions of the strips 5A, 5B being juxtaposed and over most of their surface in abutting relationship and when the bag is expanded on cooking the contents, the exposed surface 5E or 5F of the unattached lower portion lies along the opposite bag wall 2B or 2A and is exposed to the main volume of the bag interior and steam action influences.

What is claimed:

1. A cooking container comprising:

a bag or pouch, formed of plastics film material with the bottom and sides of the container being sealed together or closed;

a top or upper portion of the bag or pouch forming an initially-provided access opening; and a releasable seal on the bag or pouch for enabling sealing of the container after foodstuffs have been inserted into the container body through the access opening, such releasable seal being adapted to or being such as to remain sealed when the product is cooked;

wherein the releasable seal includes a first strip of plastic material and a second strip of plastic material, said first and second strips being secured along their length on opposite inner sides of the bag, with the first strip having a bead or groove and the second strip having a free end flexible extension strip or flap extending from a section of the second strip along its length;

wherein the flexible extension strip or flap of the second strip extends away from an interior of the bag or pouch and a groove or bead of the second strip facing away from the bead or groove of the first strip when not folded and, when folded, the flexible extension strip or flap of the second strip has a fold that includes a folded over portion with the groove or bead facing the bead or groove of the first strip such that the releasable seal is formed when the bead or groove of the first strip is pressed by press-fit against the groove or bead of the folded over portion on the second strip, and wherein the fold in the flexible extension strip or flap, which is located between the section of the second strip and the groove or bead of the flexible extension strip or flap, extends beyond the bead and groove and closer to the access opening than the groove or bead of the flexible extension strip or flap such that when the pressure increases inside the container when cooking takes place, the pressure exerts a force on an interior surface of the folded over portion of the flexible extension strip or flap and urges together the bead and groove of the seal formed by the first and second strips, wherein the sides of the container extend beyond the fold in the flexible extension strip or flap towards the access opening.

2. The cooking container as claimed in claim 1, wherein the bag or pouch comprises a substantially rectangular form.

3. The cooking container as claimed in claim 1, wherein the releasable seal comprises a zip-like or press-fit arrangement wherein on the inner side of each of the plastics film material in the region of the top or upper portion thereof, two plastics material strips are secured to respective inside portions of the plastics film material forming the side portions of the container, which strips, when the two sides are pressed together in the top or upper portion region, cooperate and form a sealing means.

4. The cooking container as claimed in claim 1, wherein the material of the releasable seal is selected to ensure that, when sealed, the container will not burst open in such top portion when the container is placed in a microwave oven and cooking therein takes place.

5. The cooking container as claimed in claim 1, wherein when the pressure increases inside the cooking container when cooking takes place, the two strips of the formed seal are urged together to prevent the formed seal from being breached or steam escaping or minimizes the possibility of such.

6. The cooking container as claimed in claim 1, wherein the releasable seal is reusable or releasably resealable so that once cooking has taken place of foodstuffs then same can be removed from the cooking container which can then be cleaned internally and thereafter used for further foodstuffs.

7. The cooking container as claimed in claim 1, wherein the bag is formed of bi-layer laminated sheet material of polyester and polypropylene or polyester and polyethylene with the polyester being on the outside, and for the closure means such are preferably polypropylene or polyethylene.

8. A bag of flexible plastics material for enabling food to be cooked therein under pressure comprising:

an initially-provided access opening or mouth closable using a releasable seal or closure in the form of a press-fit bead-and-groove or rib-and-channel closure;

a projection portion is on a first strip of plastics material secured along its length to an inner surface of one side of the bag wall; and a groove or channel forming portion is formed on a second strip of plastics material secured along its length to an inner surface of a second and opposite side of the bag wall;

wherein one of said strips has a flexible extension strip or flap extending from a section of said one strip along its length, said flexible extension strip or flap extends away from an interior of the bag and a groove or bead of the flexible extension strip or flap faces away from the bead or groove of the other strip when not folded and, when folded, the flexible extension strip or flap of the one of the said strips has a fold having a folded over portion with the groove or bead of the closure of said strip facing the bead or groove of the other strip;

wherein the fold in the flexible extension strip or flap, which is located between the section of said one strip and the bead or groove of the closure on the flexible extension or strip or flap, extends beyond the bead or groove and closer to the access opening than the bead or groove when the closure is closed, and wherein, when the closure is closed, the flexible extension strip or flap presents a surface opposite to that where the bead or groove is formed such as to present said surface exposed to steam and other pressure during cooking the contents of the bag that exerts a force on an interior surface of the folded over portion of the flexible extension strip or flap and urges the bead and groove portions together to maintain the seal, wherein the sides of the bag wall extend beyond the fold in the flexible extension strip or flap towards the access opening.

9. The bag as claimed in claim 8, wherein each of said strips is secured along its length to the bag material at least along upper and lower regions thereof and above and below of the respective bead or groove closure portion.

10. The bag as claimed in claim 8, wherein the strips are less flexible than the walls of the bag to expose the unsecured face to steam action.

11. The bag as claimed in claim 8, wherein the both strips are secured at opposite ends to the bag wall and to a flexible extension strip or flap extends therefrom with a free end and includes the bead/rib of the closure.

12. A bag for enabling food to be cooked therein, the bag comprising:

film or sheet plastics material to form the bag; and an initially-provided access opening on the bag provided with releasable and re-sealable closure or sealing means for enabling sealing of the bag after foodstuffs have been inserted, said closure or sealing means being adapted to or being such as to enable steam and/or other pressure within the bag to act to urge the two parts of the closure/sealing means together to assist in the bag remaining sealed when the product is cooked;

wherein the closure or sealing means includes two strips of plastic material having a press-fit means, each of the two strips being secured along their length at opposite inner sides of the bag with one strip having a free end flexible extension strip or flap extending from a section of the one strip along its length;

wherein the flexible extension strip or flap extends away from an interior of the bag and a groove or bead of the flexible extension strip or flap faces away from a bead or groove of the other strip when not folded and, when folded, the flexible extension strip or flap of the one strip has a fold that includes a folded over portion with a bead or groove of the press fit means facing the bead or groove of the other strip, and wherein the fold in the flexible extension strip or flap, which is located between the section of the one strip and the bead or groove of the flexible extension strip or flap, extends beyond the bead or groove and closer to the access opening than the press fit means such that when the pressure increases inside the container when cooking takes places, such acts to urge together the press fit means by exertion of a force a force on an interior surface of the folded over portion of the flexible extension strip or flap of the bag, wherein the sides of the bag extend beyond the fold in the flexible extension strip or flap towards the access opening.

13. The bag as claimed in claim 12, wherein the sealing means is in the form of the two strips of plastics material, one strip secured to a respective one of the inner sides of the film or sheet plastics material in the region of the top portion thereof having press-fit means associated therewith whereby when such strips are pressed together, a seal is formed when the pressure increases inside the bag or pouch when cooking takes place, acts to urge together the press-fitting seal between the two plastic strip members and thereby prevents such press-fitted sealing means from being breached or steam escaping or minimizes the possibility of such.

14. A pouch comprising:

flexible plastics material for enabling food to be cooked therein above atmospheric pressure;

an initially-provided access opening or mouth on the pouch closable by means of a releasable sealing or closure means in the form of a press-fit bead-and-groove or rib-and-channel closure means;

a projection portion is on a first strip of plastics material secured along its length to an inner surface of one side of the pouch wall;

a groove or channel forming portion is formed on a second strip of plastics material secured along its length to an inner surface of a second and opposite side of the pouch wall;

a freely extending flap, extended from a section of one strip along its length, having a fold that includes a folded over portion carrying the bead or the groove presenting when the closure is closed a surface remote from that where the bead or groove is formed such as to present said surface exposed to steam and other pressure during cooking the contents of the pouch as to cover the bead and groove portions and/or to exert a force on an interior surface of the folded over portion of the pouch to urge the press fitter bead and groove portions together to maintain the seal, wherein the freely extending flap extends away from an interior of the pouch and a groove or bead of the freely extending flap faces away from the bead or groove of the other strip when not folded and, when folded, the freely extending flap having the folded over portion with the groove or bead of the freely extending flap facing the bead or groove of the other strip, and wherein the fold in the freely extending flap, which is located between the section of the one strip and the bead or the groove carried on the freely extending flap, extends beyond the bead and groove and closer to the access opening than the bead or groove of the closed closure means, wherein the sides of the pouch wall extend beyond the fold in the flexible extension strip or flap towards the access opening.

* * * * *